United States Patent [19]

Gansley

[11] 4,157,105

[45] Jun. 5, 1979

[54] PORTABLE LOG SPLITTER

[75] Inventor: Byron J. Gansley, Plymouth, Mich.

[73] Assignee: Harold Phelps, Plymouth, Mich.

[21] Appl. No.: 820,398

[22] Filed: Jul. 29, 1977

[51] Int. Cl.[2] ..... B27L 7/00

[52] U.S. Cl. ..... 144/193 A; 144/193 E; 144/193 K; 144/287; 248/316 A

[58] Field of Search ..... 144/193 R, 193 K, 193 A, 144/193 D, 193 E, 3 K, 287; 269/208; 248/316 A; 24/263

[56] References Cited

U.S. PATENT DOCUMENTS

| | | | |
|---|---|---|---|
| 1,581,138 | 4/1926 | O'Loughlin | 269/208 |
| 1,864,840 | 6/1932 | Lehner | 144/287 |
| 3,077,214 | 2/1963 | Brukner | 144/193 A |
| 3,938,567 | 2/1976 | Dirckson et al. | 144/193 E |

FOREIGN PATENT DOCUMENTS

| | | | |
|---|---|---|---|
| 103542 | 1/1942 | Sweden | 144/194 |

*Primary Examiner*—Donald R. Schran
*Assistant Examiner*—W. D. Bray
*Attorney, Agent, or Firm*—Fisher, Gerhardt, Groh

[57] ABSTRACT

A collapsible, portable log splitter which extends from a compact storage or transport position to an operating position in which a hydraulic cylinder is used to move a log into splitting engagement with a blade assembly. The blade assembly includes a plurality of splitting elements having multiple faces disposed in diverging relationship to each other to form a wedging action during splitting of a log. The splitting elements are separately replaceable.

8 Claims, 7 Drawing Figures

Fig-1
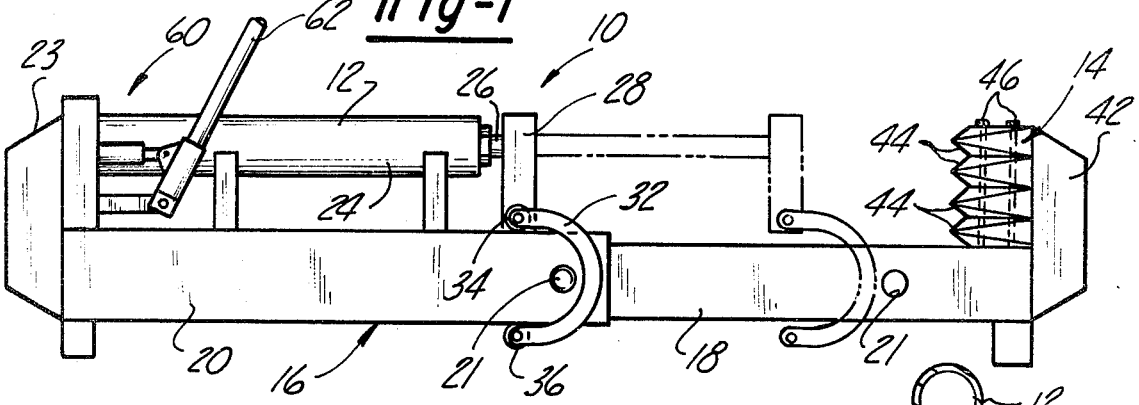
Fig-3
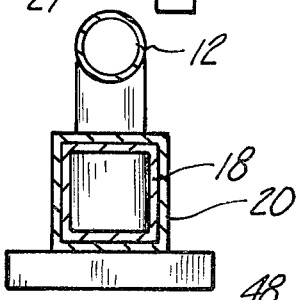
Fig-2
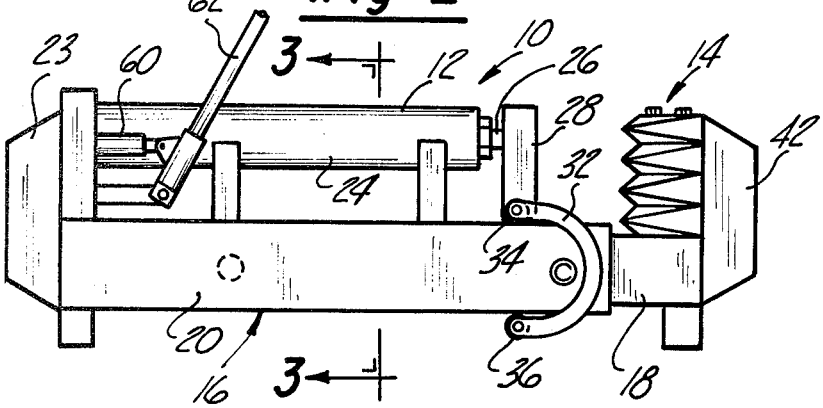
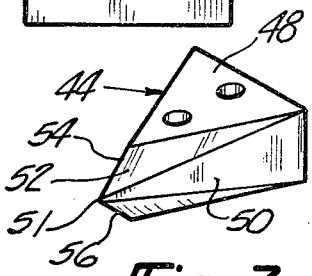
Fig-7
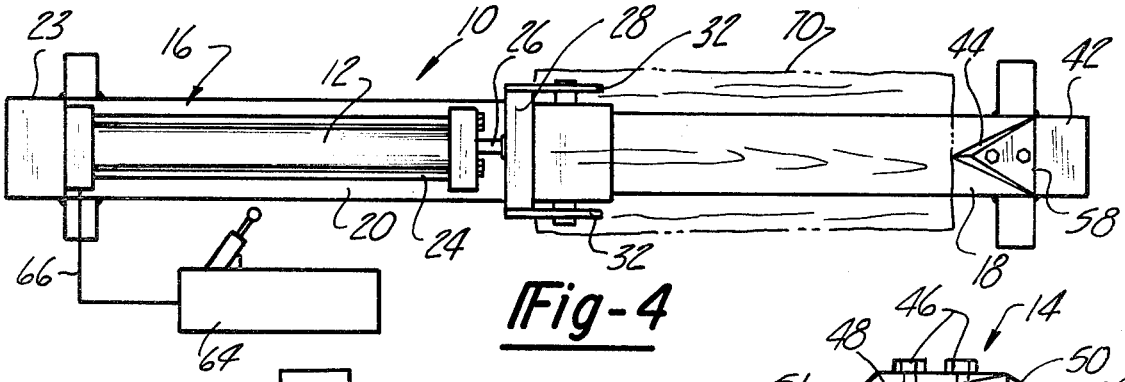
Fig-4
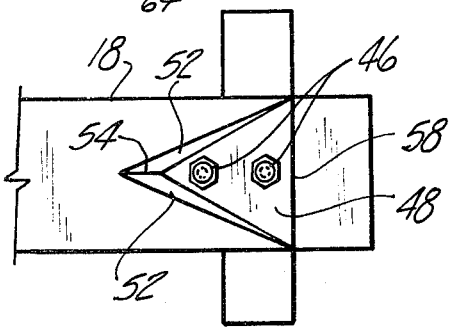
Fig-5
Fig-6
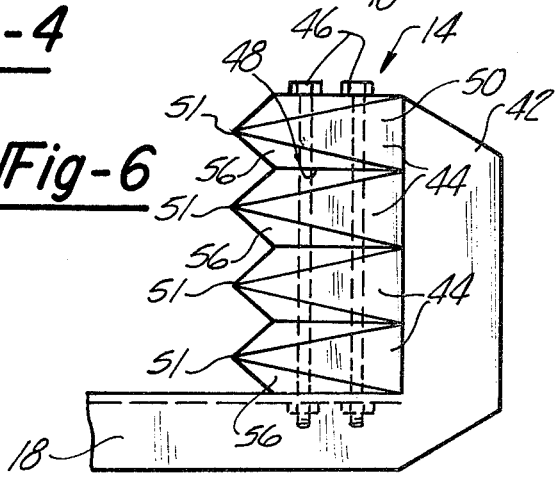

PORTABLE LOG SPLITTER

This invention relates to apparatus for splitting logs and particularly to a manually operated, hydraulic log splitter.

Log splitters have been provided in which force generated by hydraulic cylinders has been used to split logs. All of such devices are relatively heavy and as a consequence can be transported only with considerable difficulty. Moreover such log splitters are too expensive to become a common item of household equipment.

It is an object of the invention to provide a hydraulic log splitter which may be operated manually or by using power.

Another object of the invention is to provide a log splitter which is light and portable and which may be used indoors or outdoors.

Still another object of the invention is to provide a log splitter which has an extended position when in use and which may be collapsed to a storage or transport position.

Additionally, it is an object of the invention to provide a blade member for use in a hydraulic log splitter which reduces the amount of force that must be applied to split a log.

A log splitter has been provided wherein a base member supports the hydraulic actuator for moving the log into splitting engagement with a blade member. The blade member includes a plurality of identical wedge members which are detachably connected to the base member so that they may be removed as a unit or separately for individual replacement and repair. The base member extends from a storage position in which the blade member is closely adjacent to the end of the hydraulic actuator to an operable position in which the hydraulic actuator and blade member are spaced apart sufficiently to receive a log therebetween.

These and other objects will be apparent from the description and from the drawings in which:

FIG. 1 is a side elevation of the log splitter shown in its open position ready for use;

FIG. 2 is a view similar to FIG. 1 but showing the hydraulic log splitter in its collapsed, transport position;

FIG. 3 is a cross-sectional view taken on line 3—3 in FIG. 2;

FIG. 4 is a top plan view of the log splitter as seen in FIG. 1;

FIG. 5 is an enlarged view of a portion of the log splitter as seen in FIG. 1;

FIG. 6 is a top view of that portion of the log splitter seen in FIG. 5; and

FIG. 7 is a perspective view of one of the tooth elements used in the log splitter.

The hydraulic log splitter embodying the invention is designated generally at 10, and includes a hydraulic actuator 12 and a blade assembly 14 for engaging and penetrating a log to split it upon relative movement of the log by the hydraulic actuator.

The hydraulic actuator 12 and the blade 14 are mounted on a base assembly 16. Said base member includes a pair of telescoping tube members 18 and 20 which have a generally square cross-section. The smaller tube 18 telescopes within the larger tube 20. As seen in FIG. 1 the base assembly 16 is in an extended position in which case a pin 21 passes through aligned openings in the tube portion 18 and tube portion 20. The smaller tube 18 is provided with an additional opening 22 which receives the pin 21 when the base assembly 16 is in its transport or storage position.

One end of the larger tube member 20 is provided with a bracket 23 which supports one end of the hydraulic actuator 12. The hydraulic actuator 12 includes a cylinder 24 and an extensible or reciprocating rod 26, the end of which has a pad 28. The pad 28 is provided with a guide assembly which includes a pair of C-shaped members 32 disposed at opposite sides of the base assembly 16. The ends of the C-shaped member support opposite ends of axles for rollers 34 and 36 which engage, respectively, the top and bottom of the base assembly 16 during movement of the rod 26 relative to the cylinder 24. The C-shaped members 32 of the guide assembly 30 provide clearance for the pin 21 which projects slightly from opposite sides of the tube 20 and permits movement of the guide assembly to the right as viewed in FIG. 1.

The smaller tube 18 supports a bracket member 42 which is similar to the bracket member 23. The bracket 42 acts to locate the blade assembly 14 which includes a plurality of splitting elements 44.

The splitting elements 44 are identical in configuration and preferably four are used in the blade assembly 14, although it will be understood that a lesser or greater number could be used. The splitting elements are arranged in a layer and are held in position by bolts 46 which pass through all of the splitting elements 44 and a wall of the tubular member 18.

The splitting elements 44 have a plurality of triangular facets or faces. Each splitting element 44 has a pair of identical triangular upper and lower surfaces 48 which are parallel to each other and are adapted to abut adjoining surfaces 48 of adjacent teeth. A pair of opposed triangular side surfaces 50 are formed to meet at a point 51 and to diverge therefrom. The top surface 48 and the pair of side surfaces 50 adjoin a pair of triangular faces 52 which join each other at an edge 54. Similarly, faces 56 adjoin the sides 50 and the bottom surface 48 and also adjoin each other to form an edge 56. The edges 54 and 56 also diverge from each other from the point 51. The rear, generally rectilinear back surface 58 of each element 44 is held in abutting engagement with the bracket 42 by means of the bolts 46.

Hydraulic fluid for extending the rod 26 from the cylinder 24 is provided by a pump assembly 60. The pump 60 is actuated by pumping a removable handle 62. Although the pump 60 is formed substantially intergrally with the hydraulic actuator 12 it will be understood that a remote hand operator pump 64 can be connected by a line 66 to the cylinder 24. In such remote pumps 64 increase the speed at which the actuating rod 26 is extended from the cylinder 24 and may be more desirable under certain conditions.

To use the log splitter 10, the base assembly 16 is extended from its storage position seen in FIG. 2 to the position seen in FIG. 1 by removing the pin 21 and sliding the tube 18 from within the tube 20, after which the pin 21 is replaced in the aligned openings to hold the tubes 18 and 20 in the extended position seen in FIG. 1. A log indicated at 70 is placed on the base member with one end in engagement with the splitting elements 44. The pump 60 is actuated upon swinging the handle 62 which causes hydraulic fluid to extend the piston rod 26 to bring the pad 28 into engagement with the other end of the log 70. Subsequent swinging of the handle 62 further increases the hydraulic pressure in the cylinder 24 and forces the log against the points 51 of splitting elements 44. The points 51 of the splitting elements pierce the end of the log and the various adjoining surfaces and faces 48, 50 and 52 which diverge from the point 51, act as wedges to force the wood fibers apart. With some types of wood splitting occurs after the splitting elements 44 pierce the wood only a small distance, while with still other types of wood, the rod 26 must be extended for substantially its full length to cause separation of the log into two parts.

Although manual force is used to activate the pumps 60 and 64 for establishing hydraulic pressure it will be understood that hydraulic pumps driven by an electric motor also could be used to establish hydraulic pressure in the cylinder 24 for bringing about the splitting action of the log splitter 10.

A log splitter has been provided which may be collapsed to a compact storage or transport position and which may be extended to an operative position for splitting logs. In the operative position a hydraulic cylinder is used to move the log into splitting engagement with a blade assembly which includes a plurality of splitting elements with multiple faces disposed at angles to each other to form wedges. Hydraulic pressure in the cylinder is created by a manually operated pump formed integrally with the hydraulic actuator or separately if desired. Also, one embodiment of the invention contemplates an electric motor to power a hydraulic pump for operating the hydraulic cylinder. The splitting elements of the blade assembly may be removed and replaced as a unit or separately when wear or damage requires servicing.

I claim:

1. A portable log splitter comprising; a base assembly, a blade fixed on said base for penetrating one end of a log, a hydraulic actuator fixedly mounted on said base and having a rod extendable toward said blade, and a pump operable to deliver hydraulic fluid to said actuator to extend said rod into engagement with a log and force it into engagement with said blade, said base being extendable from a storage position in which said hydraulic actuator is in its collapsed position and the end of said rod is adjacent to said blade to an operative position in which said hydraulic actuator and blade are spaced apart to receive a log therebetween.

2. The combination of claim 1 in which said blade includes a plurality of vertically spaced tooth members.

3. A portable log splitter comprising; a base assembly, a blade fixed on said base for penetrating one end of a log, a hydraulic actuator fixedly mounted on said base and having a rod extendable toward said blade, and a pump operable to deliver hydraulic fluid to said actuator to extend said rod into engagement with a log and force it into engagement with said blade, and blade including a plurality of vertically spaced tooth members wherein said tooth members are separable from each other and are detachably supported on said base.

4. The combination of claim 3 in which each of said tooth members has a pair of diverging side surfaces meeting at a point, a pair of upper surfaces diverging from a first edge portion, and a pair of lower surfaces diverging from a second edge portion, said point and said edge portions being engageable with a log to be split.

5. The combination of claim 4 in which the first and second edge portions diverge from said point.

6. A portable log splitter comprising; a base assembly, a blade fixed on said base for penetrating one end of a log, an actuator means mounted on said base and having a movable portion extendable toward said blade, said actuator means being operable to move said movable portion into engagement with a log and force it into engagement with said blade, said blade including a plurality of vertically spaced tooth members, said tooth members being separable from each other and detachably supported on said base.

7. The combination of claim 6 wherein each of said tooth members has a pair of triangular side surfaces meeting at a point and diverging from each other, a pair of upper surfaces and a pair of lower surfaces, each pair of surfaces diverging from first and second edge portions respectively, said point and said edge portions being engagable with a log to be split.

8. The combination of claim 6 wherein said base assembly is extendable from a storage position in which said movable portion is in a retracted position and adjacent to said blade to an operative position in which said movable portion is spaced from said blade to receive a log therebetween.

* * * * *